US010165853B2

(12) United States Patent
Omidinejad

(10) Patent No.: US 10,165,853 B2
(45) Date of Patent: Jan. 1, 2019

(54) FOLDABLE TABLE ATTACHED TO THE CEILING

(71) Applicant: Reza Omidinejad, Karaj (IR)

(72) Inventor: Reza Omidinejad, Karaj (IR)

( * ) Notice: Subject to any disclaimer, the term of this patent is extended or adjusted under 35 U.S.C. 154(b) by 0 days.

(21) Appl. No.: 15/721,903

(22) Filed: Sep. 30, 2017

(65) Prior Publication Data

US 2018/0020821 A1 Jan. 25, 2018

(30) Foreign Application Priority Data

Oct. 5, 2016 (IR) ..... 13955014000300849

(51) Int. Cl.

| | |
|---|---|
| ***A47B 3/00*** | (2006.01) |
| ***A47B 3/06*** | (2006.01) |
| ***A47B 3/14*** | (2006.01) |
| *A47B 5/00* | (2006.01) |

(52) U.S. Cl.

CPC ..... *A47B 3/063* (2017.08); *A47B 3/002* (2013.01); *A47B 3/14* (2013.01); *A47B 2005/003* (2013.01)

(58) Field of Classification Search

CPC ..... A47B 3/063; A47B 3/08; A47B 3/002; A47B 3/14; A47B 5/06; A47B 5/00; A47B 2005/003

USPC ..... 108/149

See application file for complete search history.

(56) References Cited

U.S. PATENT DOCUMENTS

| | | | | |
|---|---|---|---|---|
| 2,580,980 | A | 1/1952 | Vrooman | |
| 2,844,428 | A * | 7/1958 | Puntenney | A47B 13/00 108/115 |
| 3,592,146 | A * | 7/1971 | Loomans | A47B 5/00 108/149 |
| 3,743,287 | A * | 7/1973 | Liermann | A63D 15/04 108/149 |
| 3,931,452 | A | 1/1976 | Nilsson | |
| 4,032,770 | A * | 6/1977 | Millette | A47B 5/00 362/127 |
| 4,815,396 | A * | 3/1989 | Gehring | A47B 5/00 108/149 |
| 6,079,338 | A | 6/2000 | Yeh | |
| 6,105,510 | A | 8/2000 | Skoff | |
| 6,202,361 | B1 * | 3/2001 | Thorp | A47B 5/00 108/149 |
| 6,651,568 | B1 | 11/2003 | Buono | |
| 6,779,466 | B2 | 8/2004 | Shabram | |
| 6,997,111 | B2 | 2/2006 | Giegerich | |
| 7,168,371 | B1 * | 1/2007 | Ruff | A47B 5/06 108/20 |
| 7,174,838 | B2 | 2/2007 | Sagol | |
| 7,219,472 | B2 | 5/2007 | Gallant | |
| 7,434,874 | B2 | 10/2008 | Jordan | |

(Continued)

*Primary Examiner* — Daniel J Rohrhoff

(74) *Attorney, Agent, or Firm* — NovoTechIP International PLLC

(57) ABSTRACT

An improved system and method of automatic folding and storage of furniture is disclosed. In one embodiment, an improved combination foldable table and seats system provides a mechanism for automatically raising the combination foldable table and seats system to a ceiling before automatically folding the legs of the table to which foldable seats are attached. In this manner, the combination foldable table and seats system can be folded, stored and again lowered to the ground without the need for a user to lift or move furniture and without the need for extra storage space.

16 Claims, 9 Drawing Sheets

(56) References Cited

U.S. PATENT DOCUMENTS

| | | | | |
|---|---|---|---|---|
| 8,667,907 | B2 | 3/2014 | Grace | |
| 9,523,463 | B2 | 12/2016 | Abri | |
| 2002/0178497 | A1* | 12/2002 | Thurston | A47C 17/84 5/10.1 |
| 2003/0089286 | A1 | 5/2003 | Wang | |
| 2003/0205180 | A1 | 11/2003 | Bishop | |
| 2004/0020138 | A1* | 2/2004 | Grearson | E01D 19/106 52/64 |
| 2004/0139892 | A1 | 7/2004 | Geigerich | |
| 2006/0013007 | A1* | 1/2006 | Passos | A47B 5/00 362/403 |
| 2006/0120846 | A1* | 6/2006 | Krengel | A47B 5/00 414/592 |
| 2008/0116724 | A1* | 5/2008 | Dickey | A47B 3/14 297/158.4 |
| 2015/0040802 | A1 | 2/2015 | Hutchison | |
| 2015/0272323 | A1* | 10/2015 | Klooth | A47B 51/00 182/144 |

* cited by examiner

FOLDABLE TABLE ATTACHED TO THE CEILING

CROSS REFERENCE TO RELATED APPLICATION

This application claims the benefit of priority to an Iran patent application having serial number 139550140003008497, which was filed on Oct. 5, 2016, and is incorporated by reference herein in its entirety.

TECHNICAL FIELD

The present application relates generally to foldable furniture, and more particularly to foldable tables and chairs that are configured to be raised and stored on a ceiling.

BACKGROUND

Pieces of furniture such as dining tables, game tables and their associated chairs tend to occupy a large portion of space in people's homes. This can be inconvenient, particularly for those living in small living areas such as apartments and small houses. To address this and other similar problems, foldable tables and chairs have been developed. The use of such foldable furniture in households, however, is limited because folding a table and a number of chairs after each meal is labor and time intensive. Moreover, storage of such items requires large empty storage spaces.

Furniture items such as dining tables and chairs also prevent venues such as hotels providing conference rooms and dining rooms from efficiently utilizing their spaces. For example, to adequately address the needs of a client organizing a large conference, venues generally need to provide two rooms, one for the conference with rows of chairs and one with tables for dining. That is because even if foldable chairs and tables are utilized, it is often time and labor intensive to fold, remove and/or set up a large number of tables and chairs. Moreover, a large storage space will be needed for storage of such items, when not in use.

Therefore, a need exists for providing an improved system and method for folding and storage of foldable furniture.

SUMMARY

A foldable table configured for being stored on a ceiling is provided. The foldable table includes a table top having a plurality of first openings, and a plurality of foldable legs, where each foldable leg is attached to the table top. The foldable table also includes a plurality of cables each having a first end and a second, where each first end is attached to one of the plurality of legs, and each cable passes through one of the plurality of first openings. Additionally, the foldable table includes a ceiling unit attached to the ceiling and having a plurality of second openings through each one of which one of the plurality of cables passes, wherein the ceiling unit is configured to act as a housing for a control unit connected to a plurality of rotatable gears and configured to rotate at least one of the plurality of rotatable gears, and a plurality of pulleys around each one of which one of the plurality of cables passes; wherein the second end of each one of the plurality of cables is attached to one of the gears such that when each of the gears begin rotating in one direction, the cable attached to the rotating gear begins wrapping around the rotating gear.

BRIEF DESCRIPTION OF THE DRAWINGS

Features of the subject technology are set forth in the appended claims. However, for purpose of explanation, several implementations of the subject technology are set forth in the following figures.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings. As part of the description, some of this disclosure's drawings represent structures and devices in block diagram form in order to avoid obscuring the invention. In the interest of clarity, not all features of an actual implementation are described in this specification. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" means that a particular feature, structure, or characteristic described in connection with the embodiment is included in at least one embodiment of the invention, and multiple references to "one embodiment" or "an embodiment" should not be understood as necessarily all referring to the same embodiment.

Most pieces of furniture are used for particular purposes during specific times. For example, most dining tables are only used for specific meals. Game tables such as pool tables, foosball tables, or poker tables are even less likely to be used on a regular basis. These types of furniture tend to occupy a large portion of space even when they are not in use. Although many different types of foldable tables and chairs have been developed, use of such furniture is not common because of their impracticality. Folding, unfolding, and moving around pieces of furniture is time consuming and labor intensive. Moreover, a large storage space is often required to store such items.

A solution is proposed here to solve these issues and more by providing an improved system that offers automatic folding, unfolding, and moving of furniture. Additionally, the improved system provides an efficient storage mechanism by storing the furniture on the ceiling when not in use.

Figure 1:
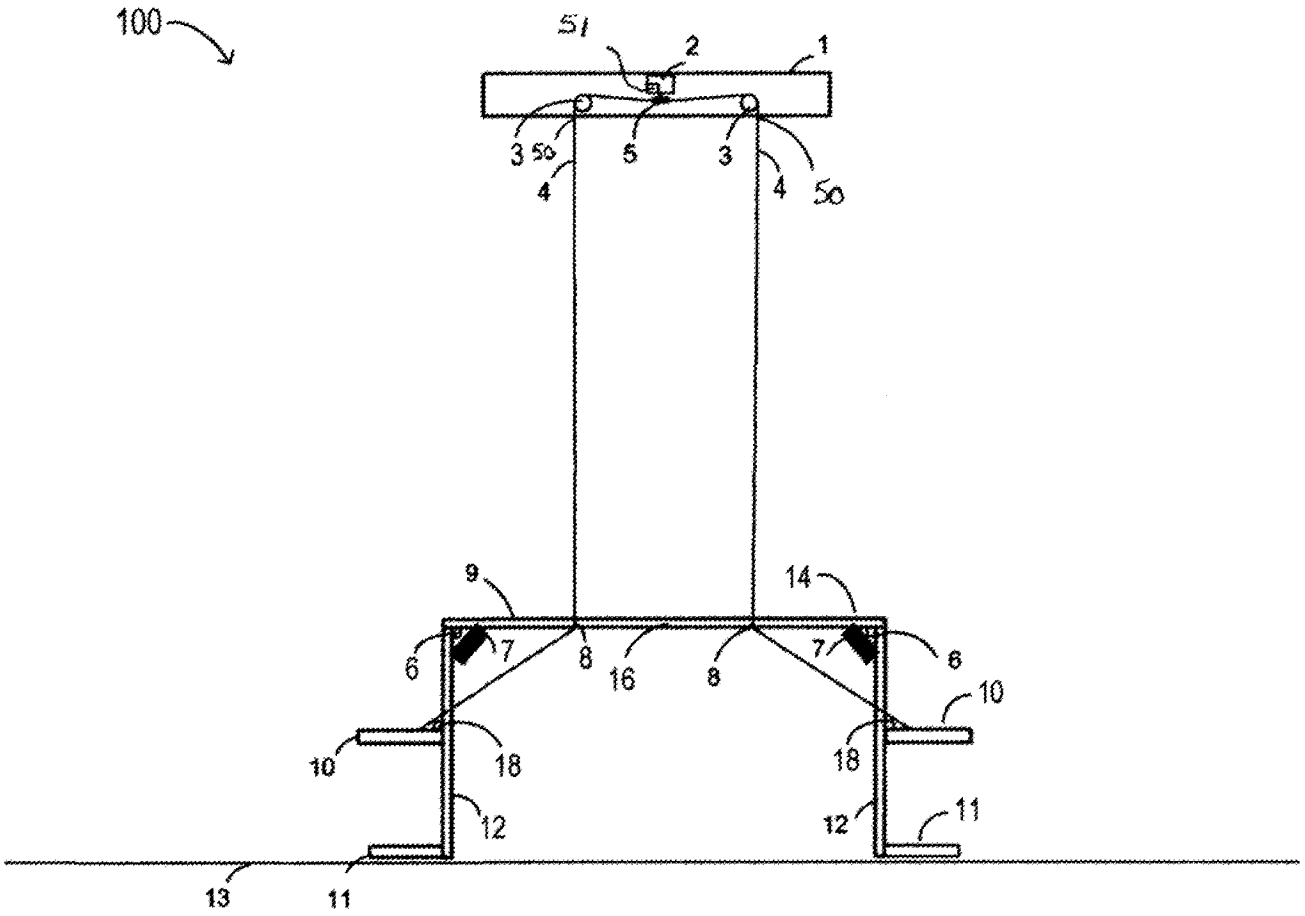
FIG. 1 illustrates a schematic drawing of a foldable table with attached foldable seats, when the unit is unfolded, positioned on the floor and is ready for use, according to an implementation.

FIG. 1 illustrates one implementation of an improved combination table and seats system 100 which is foldable and storable on a ceiling. In the configuration shown in FIG. 1, the combination table and seats system 100 has been lowered to the floor and unfolded for use. In one implementation, the improved combination table and seats system 100 includes a table top 9 having a top surface 14 and a bottom surface 16, where the bottom surface is connected to four legs 12 (only two shown for simplicity). In one implementation, each leg 12 is attached to the table top 9 using a hinge 6 which is connected to a spring 7. In the implementation shown in FIG. 1, the table top 9 has a square shape with each leg 12 being placed approximately in the middle of each side. However, other configurations are also contemplated. For example, in one implementation, the table top may be rectangular in shape. Alternatively, a round or oval shape table top may be used in which case the legs may be spaced around the circumference of the round table top.

In one implementation, each leg is attached to a foldable seat 10 via a hinge 18. The foldable seats 10 provide a convenient seating area for people to sit on and utilize the table for various purposes. The foldable seats 10 are each attached to the table, via their corresponding legs 12, and can be folded when they are not in use. In one implementation, each foldable seat 10 is folded automatically when the improved combination table and seats system 100 is folded for storage. Alternatively (or additionally), each foldable seat 10 can be folded manually when not in use. This can provide extra space around the table when the foldable seats 10 are not being utilized for sitting. In such a configuration, a locking mechanism (not shown) may be provided to lock each foldable seat 10 to its corresponding leg when it is folded manually. In one implementation, each foldable seat 10 is square in shape to provide a comfortable seating area. The square shape also provides a configuration that is easily foldable. In an alternative implementation (not shown), each foldable seat 10 may be attached to a foldable back rest that provides back support. In one configuration, the back rest can be folded on top of the foldable seat and held together with a locking mechanism, when not in use. This can be done automatically and/or manually. Alternatively, the back rest may be rotatable such that it can be folded towards the bottom of its corresponding foldable seat.

In addition to the foldable seats 10, each leg 12 is connected to a stabilizing unit 11. In one implementation, each stabilizing unit 11 is formed from the same material as that of the legs 12 and/or has the same width as that of the leg 12 to provide support for the combination table and seats system 100 when placed on the floor. Alternatively, the stabilizing units 11 can be formed from different materials and have differing widths from their associated legs. In either case, the stabilizing units 11 are configured to be placed on the floor 13 when the system 100 is lowered to the ground. As such, the stabilizing units 11 are configured to provide balance for and stabilize the system 100. In one implementation, the stabilizing units 11 are foldable and can be folded both automatically and/or manually. Alternatively, the stabilizing units 11 are not designed to be folded.

In one implementation, the combination table and seats system 100 includes a ceiling unit 1 which is attached to the ceiling (not shown). The ceiling unit 1 may be shaped like a cube and configured to house all internal elements of the system 100. In this manner, the ceiling unit 1 may provide an astatically pleasing look for the system 100 by hiding all internal elements inside the ceiling unit 1 and away from view. In one implementation, the edges of the ceiling unit 1 are placed on the ceiling, while the entire ceiling unit 1 is attached to the ceiling through a control unit 2. In one implementation, the control unit 2 includes a gear box and an electronic motor designed to control the operation of the gear box. Systems and mechanisms known in the art may be used to attach the control unit 2 to the ceiling. For example, a mechanism similar to the ones used to attach ceiling fans to the ceiling may be used. In one implementation, the control unit 2 includes electrical wiring (not shown) which runs through the ceiling to corresponding electrical wiring of the building and in turn to a switch placed on the wall. The switch may be similar to a light switch and used to initiate automatic lowering and/or raising of the system 100.

In one implementation, the system 100 may include a remote control (not shown) that is configured to facilitate automatic operation of the system 100. Other methods of facilitating automatic operation of the system 100 are also contemplated. For example, in one implementation, for buildings that are equipped and connected to computer network, a computer application may be provided for operating the table automatically and remotely.

In addition to the control unit 2, the ceiling unit 1 also contains multiple pulleys 3 (only two shown). In one implementation, the number of pulleys 3 corresponds to the number of foldable seats 10, as each foldable seat 10 is connected to a corresponding pulley 3, via a cable 4. Each cable runs through one opening 50 on the ceiling unit 1 and an opening 8 on table top 9 to attach the foldable seat 10 and the table top 9 to the ceiling unit 1. In one implementation, the openings through which each cable 4 runs are small openings that are only large enough to allow the cable to pass through. The cable 4 may be made of a material that is strong enough to support the weight of the combination table and seats system 100 when it is being pulled up to the ceiling, but is still thin enough to be astatically pleasing. In one implementation, the top end of each cable 4 is attached to a gear 5 which is connected to the gear box 51 of the control unit 2. Each one of the gears 5 corresponds to one of the pulley 3*s*. In an alternative implementation, only one gear 5 is used to which all cables 4 are attached. In one implementation, each cable runs vertically through openings on the table top 9 and ceiling unit 1 to its corresponding pulley 3. Once the cable 4 runs through the pulley 3, the direction of the pulley causes the cable 4 to run in the horizontal direction from the pulley 3 to the corresponding gear 5 attached to the control unit 2. The combination of the control unit 2 and the gears 5 control the operation of the system 100.

Figure 2:
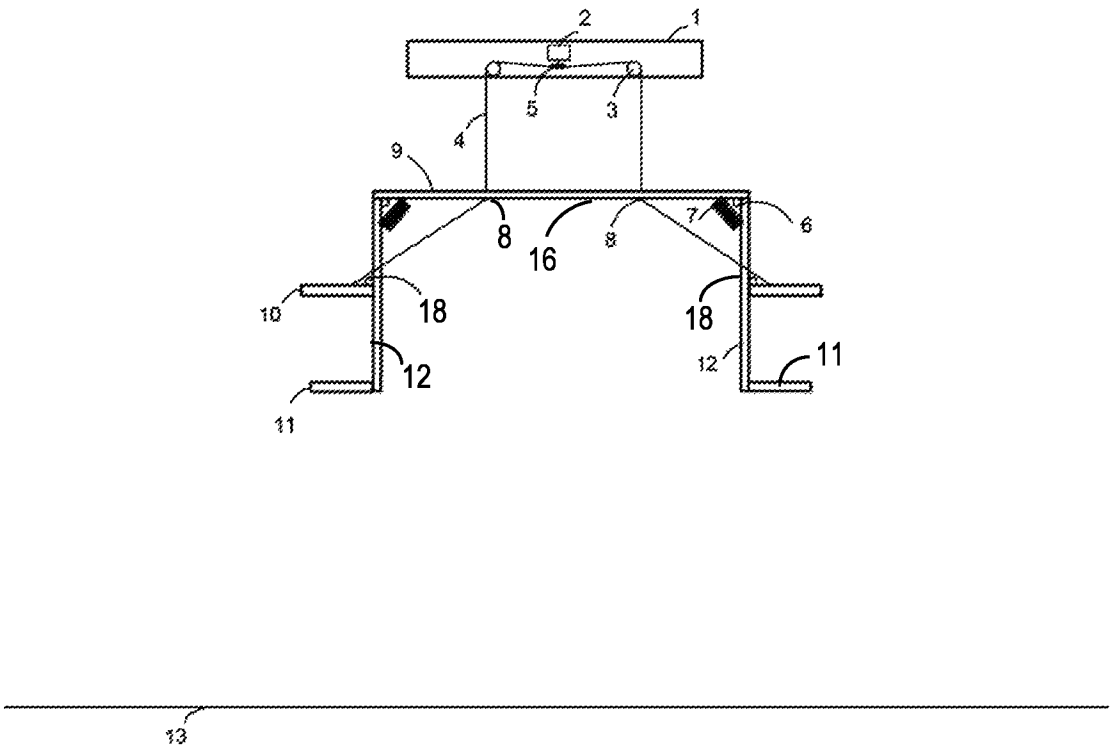
FIG. 2 illustrates a schematic drawing of the foldable table with attached foldable seats, when the unit is being raised to the ceiling, according to an implementation.

FIG. 2 illustrates one implementation of the improved combination table and seats system 100 during operation. In the implementation shown in FIG. 2, the combination table and seats system 100 is being raised to the ceiling for storage. In one implementation, the process of raising the system 100 can be initiated by a user by pressing a switch and/or operating a remote control or a computer application, as discussed above. Once the user initiates the operation, in one implementation, the control unit 2 operates to rotate the gears 5. As a result, each of the cables 4 are pulled up and wrapped around their corresponding gear 5. As the cables 4 are pulled up and wrapped around their corresponding gear 5, they pull the table top 9 and its attached legs and foldable seats along with them, thus raising the entire combination table and seat system from the floor to the ceiling. This provides an automatic and hands-free mechanism for raising the table. As a result, all the user is required to do is press a key to initiate the operation upon which the entire system is automatically raised and eventually folded.

Figure 3:
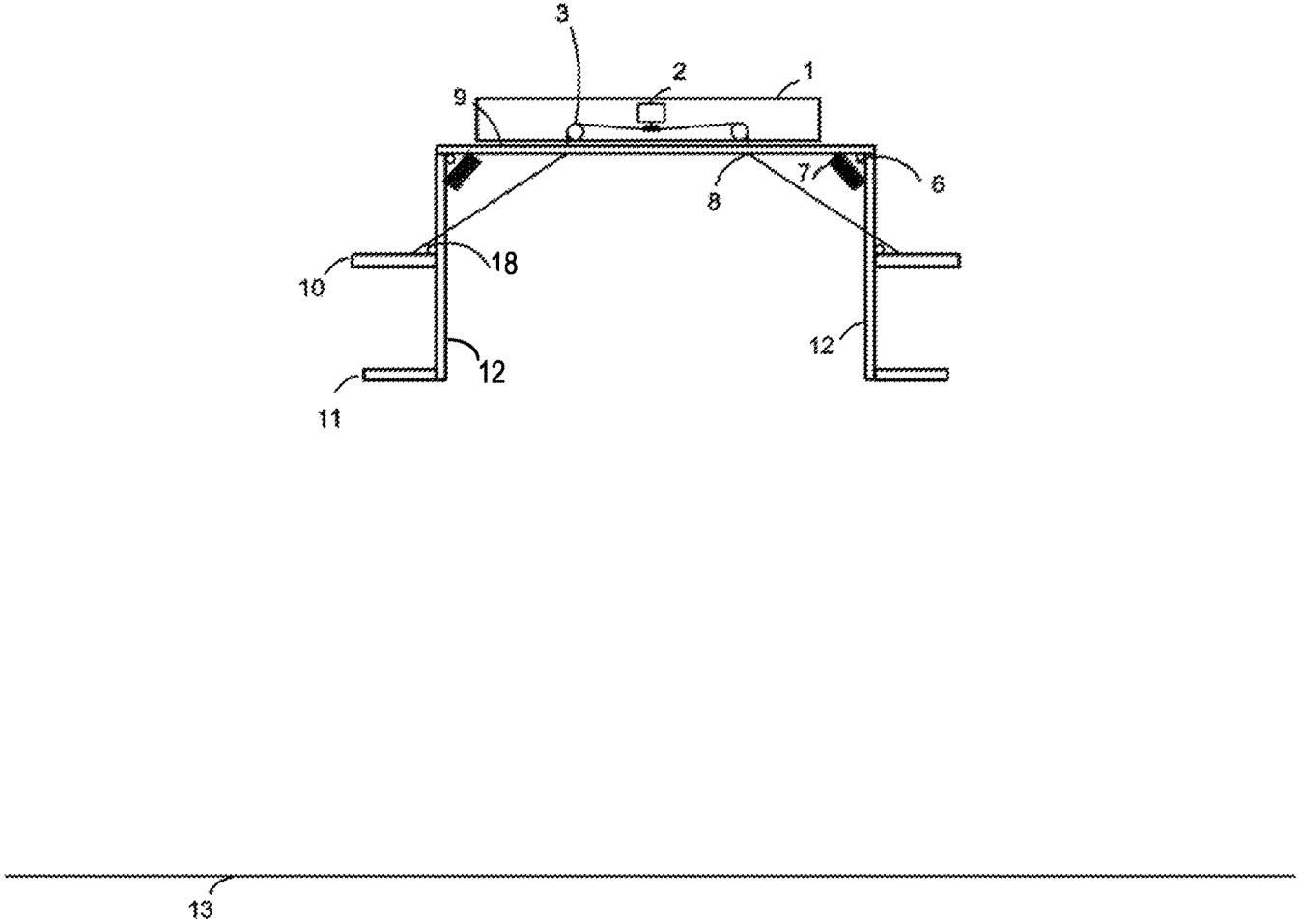
FIG. 3 illustrates a schematic drawing of the foldable table with attached foldable seats, when the unit has been raised to the ceiling but before it is folded, according to an implementation.
Figure 4:
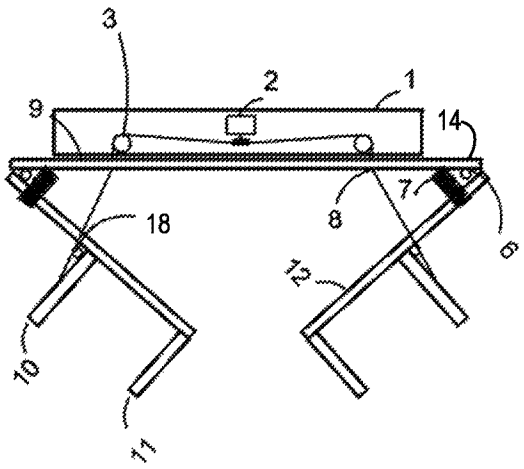
FIG. 4 illustrates a schematic drawing of the foldable table with attached foldable seats, when the unit has been raised to the ceiling and the legs are being folded, according to an implementation.

FIG. 3 illustrates one implementation of the improved combination table and seats system 100 during the next step of the operation. Cables 4 continue to be pulled up and wrapped around their corresponding gear 5, until the top surface 14 of the table top 9 reaches the outer surface of the ceiling unit 1, as shown in FIG. 3. Once the top surface 14 touches the outer surface of the ceiling unit 1, the combination table and seats system 100 has been completely pulled up to the ceiling. However, the control unit 2 continues operating, in one implementation, to rotate the gears 5 and consequently continue pulling the cables 4. Because the cables 4 are each attached to a foldable seat 10, once the table top 9 touches the ceiling unit 1, the force of each cable being pulled starts to pull the leg attached to the corresponding foldable seat 10 from its vertical position to a horizontal folded position. This is illustrated in FIG. 4. As shown, each cable 4 pulls its corresponding leg 12 from its 90 degrees position with respect to the table top 9 towards the middle of the bottom surface 16. This is achieved, in one implementation, at least in part through the operation of springs 7 and hinges 6 which allow each of the legs 12 to move and be pulled in by its corresponding cable 4.

Figure 5:
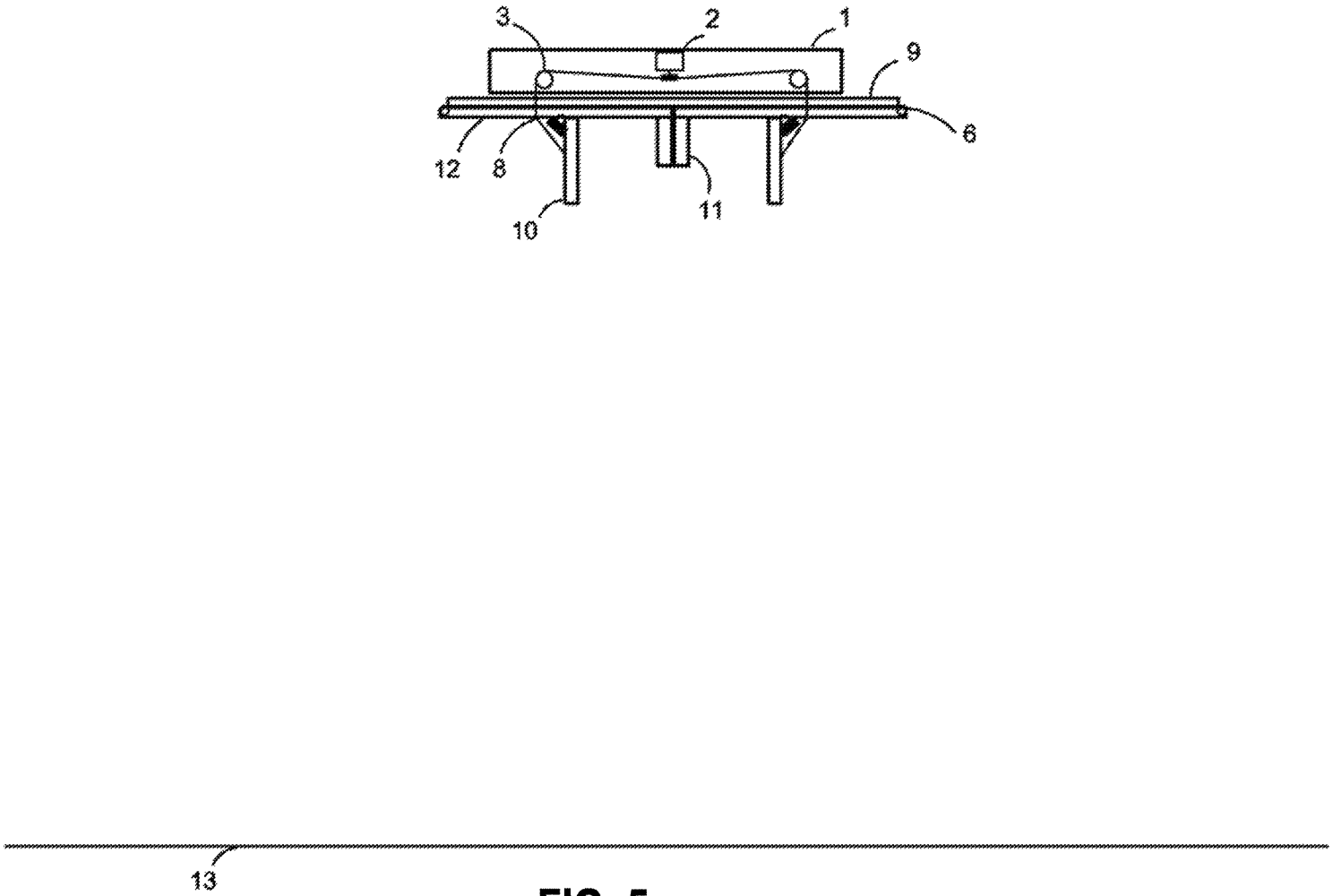
FIG. 5 illustrates a schematic drawing of the foldable table with attached foldable seats, when the unit has been raised to the ceiling and its legs have been folded, according to an implementation.

FIG. 5 illustrates one implementation of the improved combination table and seats system 100 once the table and seats combination has been pulled up and its legs folded. In one implementation, during this stage of the operation, the table and seats are adjacent to the ceiling unit 1 and thus attached to the ceiling, but the foldable seats 10 are still in their original unfolded position. This is because the force of the cable affects the legs 12 first before it is directed to the foldable seats 10. In one configuration, the control unit 2 may stop operating at this point and thus store the combination table and seats system 100 in the position illustrated in FIG. 5.

Figure 6:
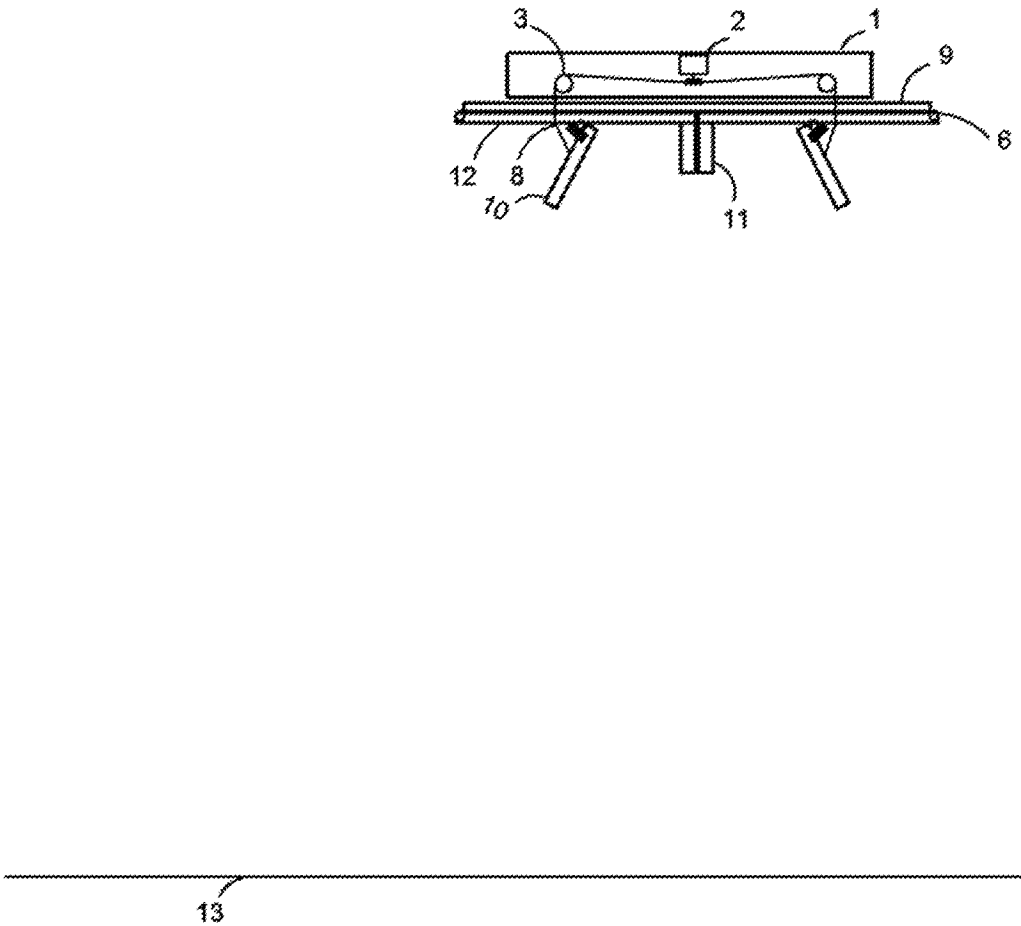
FIG. 6 illustrates a schematic drawing of the foldable table with attached foldable seats, when the unit has been raised to the ceiling, and its legs have been fold, while its seats are being folded, according to an implementation.

In an alternative implementation, the control unit 2 continues rotating the gears 5 and as a result pulling the cables 4 until the foldable seats 10 begin being pulled towards the ceiling. This is illustrated in FIG. 6. In the implementation shown, the continued operation of the system 100 causes each of the foldable seats 10 to rotate around their corresponding hinge 18 and thus move from their original vertical position shown in FIG. 5 to a horizontal position adjacent to the bottom surface 16 of the table top 9. In one implementation, the operation continues until each foldable seat 10 is completely folded, as shown in FIG. 7.

Figure 7:
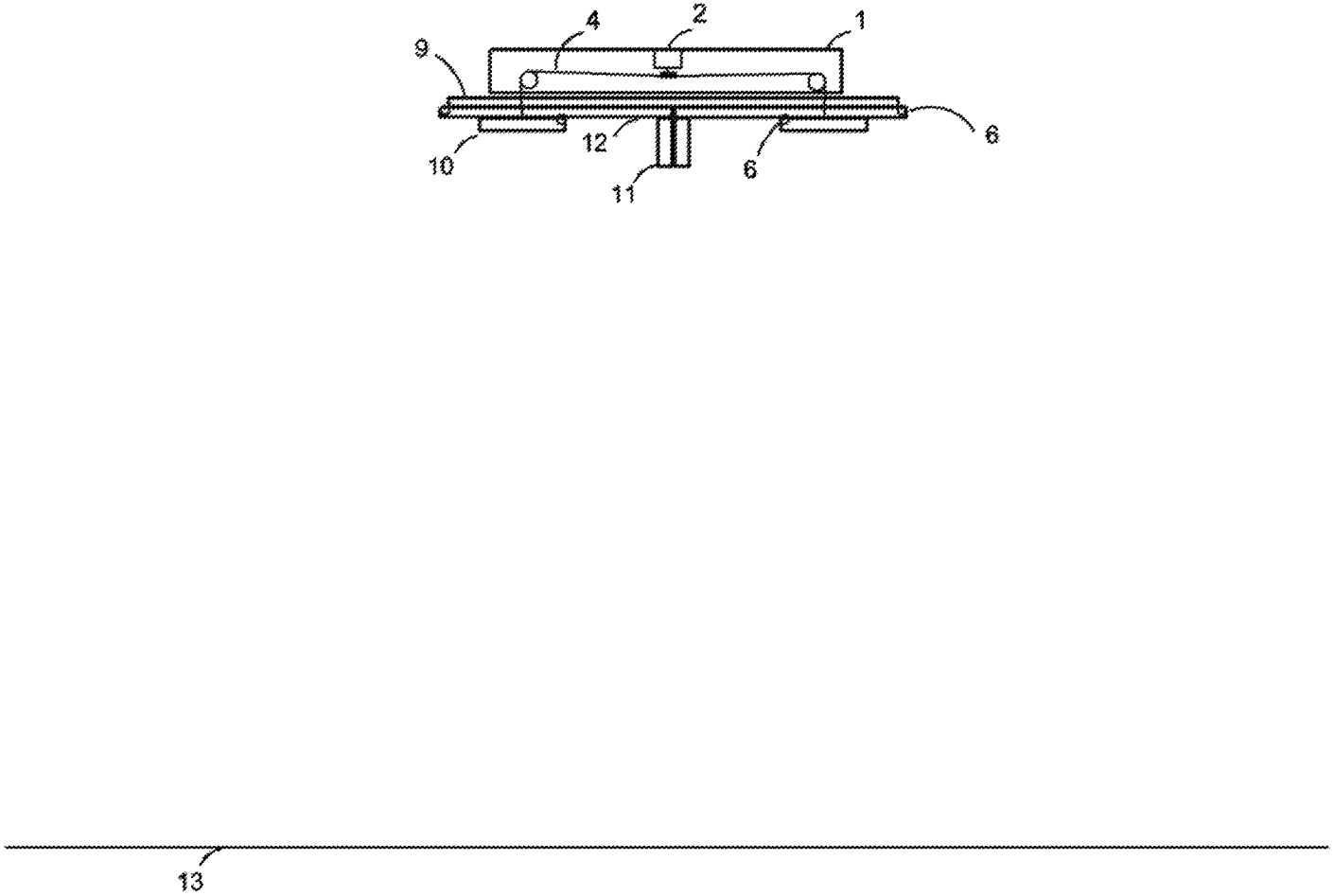
FIG. 7 illustrates a schematic drawing of the foldable table with attached foldable seats, when the unit has been raised to the ceiling for storage, according to an implementation.

FIG. 7 illustrates one implementation of the improved combination table and seats system 100 when completely folded and stored. In one implementation, once the system 100 reaches the position shown in FIG. 7, the operation automatically stops. This is done, in one configuration, once each cable 4 has been completely pulled in and wrapped around a corresponding gear 5. Once the system determines that the cable cannot be pulled in anymore, it automatically stops rotating its associated gear 5. As a result, the system and method of operation of the improved combination table and seats system 100 provides a convenient and efficient manner of utilizing a table and seats combination while allowing for easily storing the furniture when not in use.

To lower the improved combination table and seats system 100, the user would need to press a button such as the switch discussed above to initiate the operation. To lower the system 100, the control unit 2 operates to gradually rotate the gears 5 in the opposite direction from which they were turned to raise the system 100. As a result, cables 4 are gradually released from their position thus operating in reverse to first release the foldable seats 10, then the legs 12, and eventually to lower the table top 9 until the legs reach the floor 13.

Figure 8:
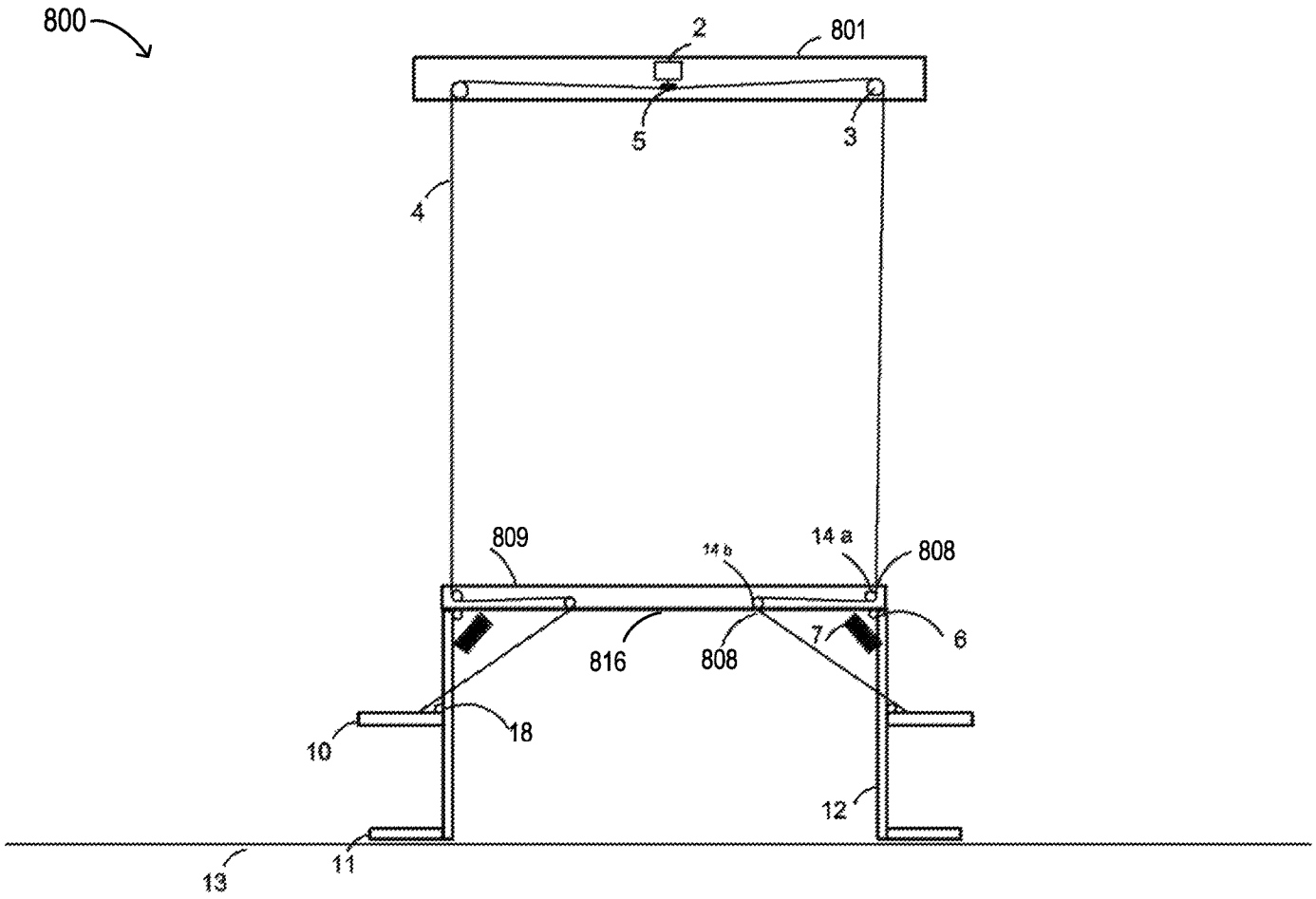
FIG. 8 illustrates a schematic drawing of an alternative implementation of a foldable table with attached foldable seats, when the unit is unfolded, positioned on the floor and is ready for use, according to an implementation.

FIG. 8 illustrates one implementation of an improved combination table and seats system 800. The improved combination table and seats system 800 includes many of the same or similar features as those of the system 100. However, the combination table and seats system 800 differs from the system 100 in that the openings 808 on the table top 809 are located closer to the edges of the table top 809. To accommodate the location of the openings 808, in one implementation, the corresponding openings (not shown) in the ceiling unit 801 are also moved closer to the edge of the outer surface of the ceiling unit 801. In one implementation, two pulleys 14*a* and 14*b* located on the bottom surface 816 of the table top 809 guide each cable 4 from its attached location to the foldable seat 10 to its corresponding opening 808. By using the pulleys 14*a* and 14*b*, the system 800 can use the same mechanism as that used in the system 100 to pull the table top 809 and its attached legs 12 up to the ceiling and ensure that once the table top 809 reaches the outer surface of the ceiling unit 801, the legs are folded inside. In one implementation, each of the legs 12 of the system 800 is attached to the square shaped table top 809 at corners where each of the two sides of the square shaped table top 809 meet.

Figure 9:
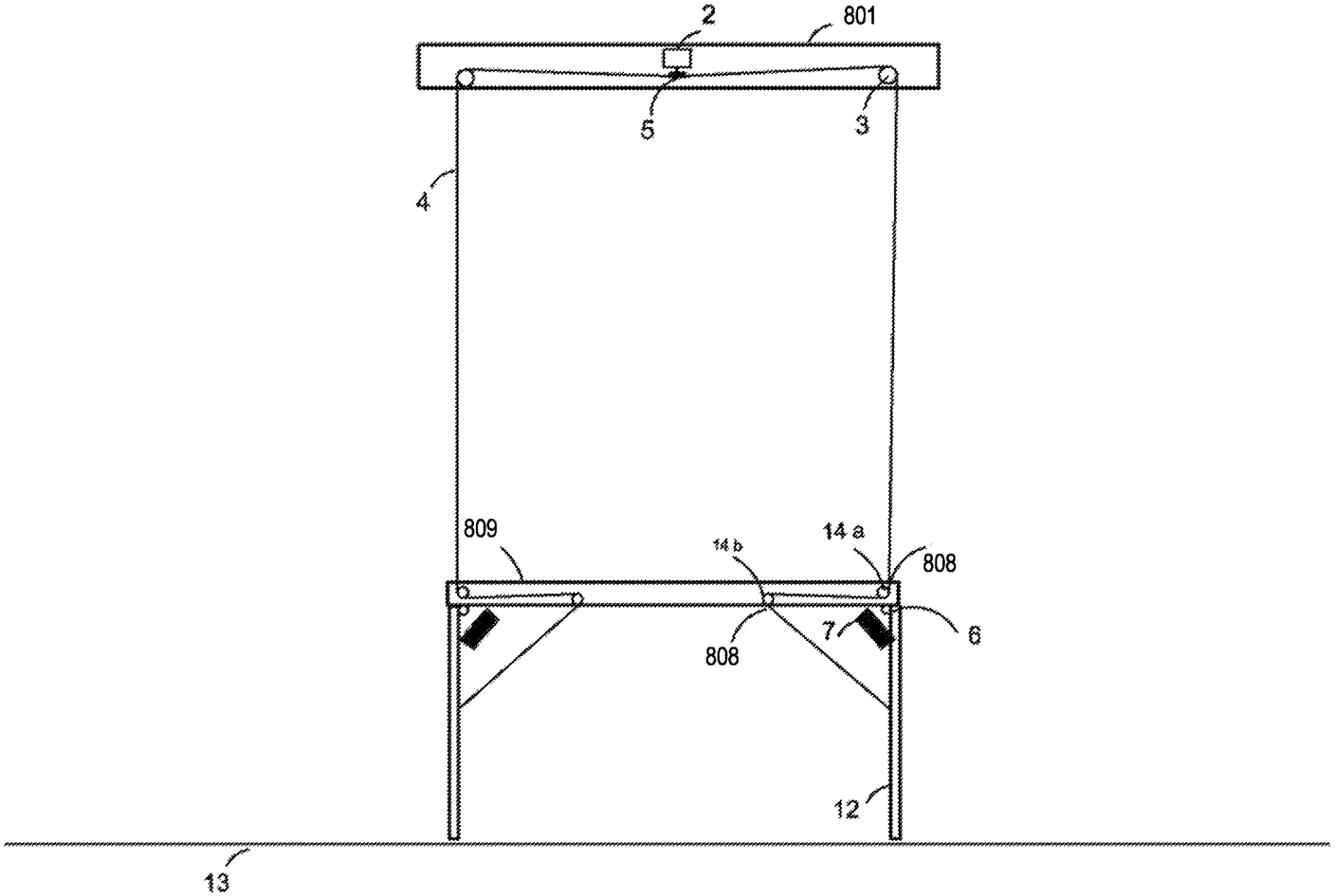
FIG. 9 illustrates a schematic drawing of an alternative implementation of a foldable table, when the unit is unfolded, positioned on the floor and is ready for use, according to an implementation.

FIG. 9 illustrates an alternative implementation of the improved foldable table system 800 which does not include the foldable seats. This alternative implementation can be used in cases where the users prefer flexible seating arrangements and/or have storage room for storing alternative chairs that can be used with the foldable table.

The systems and methods described herein can be used in a variety of other furniture configurations. For example, the ceiling unit described above can be utilized with game tables such as a pool table or a foosball table. In such implementations, cables can pass through openings on each corner of the game tables to be attached to each leg of the table on one end. The other end of the cables may pass through corresponding openings on the ceiling unit to be attached to a corresponding gear which when rotated pulls the table up and folds the legs once the table is lifted up to the ceiling.

Accordingly, the improved combination table and seats system provides an efficient system for utilizing furniture only when in use and conveniently folding and storing it without the need for extra storage space whenever it is not being used.

The separation of various components in the examples described above should not be understood as requiring such separation in all examples, and it should be understood that the described components and systems can generally be integrated together in a single packaged into multiple systems.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations for the purpose of streamlining the disclosure. This method of disclosure is not to be interpreted as reflecting an intention that the claimed implementations require more features than are expressly recited in each claim. Rather, as the following claims reflect, inventive subject matter lies in less than all features of a single disclosed implementation. Thus the following claims are hereby incorporated into the Detailed Description, with each claim standing on its own as a separately claimed subject matter.

What is claimed is:

1. A foldable table configured for being stored on a ceiling comprising:

a table top having a plurality of first openings;

a plurality of foldable legs, each attached to the table top;

a plurality of cables each having a first end and a second end, where each first end is attached to one of the plurality of legs, and each cable passes through one of the plurality of first openings;

a plurality of hinges, each one of which connecting one of the plurality of foldable legs to the table top;

a plurality of springs, each one connected to one of the plurality of hinges; and a ceiling unit attached to the ceiling and having a plurality of second openings through each one of which one of the plurality of cables passes, wherein the ceiling unit is configured to act as a housing for:

a control unit connected to a plurality of rotatable gears and configured to rotate at least one of the plurality of rotatable gears; and a plurality of pulleys around each one of which one of the plurality of cables passes; wherein the second end of each one of the plurality of cables is attached to one of the rotatable gears such that when each of the gears begin rotating in one direction, the cable attached to the rotating gear begins wrapping around the rotating gear.

2. The foldable table of claim 1, wherein the control unit includes a gear box configured to rotate the at least one of the plurality of rotatable gears.

3. The foldable table of claim 1, further comprising a plurality of foldable seats, each foldable seat attached to one of the plurality of foldable legs.

4. The foldable table of claim 3, further comprising a plurality of hinges, each one of which connecting one of the plurality of foldable seats to one of the plurality of foldable legs.

5. The foldable table of claim 3, wherein the first end of each one of the plurality of cables is connected to one of the plurality of foldable seats.

6. The foldable table of claim 1, wherein the table top is square in shape.

7. The foldable table of claim 6, wherein each of the plurality of foldable legs is located approximately in the middle of one of the sides of the square.

8. The foldable table of claim 6, wherein each of the plurality of foldable legs is located in one corner of the square shaped table top.

9. The foldable table of claim 1, wherein when each of the plurality of cables begin to wrap around their corresponding rotatable gear, the cable is pulled up to the ceiling and as such causes the table top to begin moving up towards the ceiling.

10. The foldable table of claim 9, wherein the table top is configured to move up towards the ceiling until it reaches an outer surface of the ceiling unit.

11. The foldable table of claim 10, wherein once the table top reaches the ceiling unit, continued rotation of the plurality of rotatable gears causes each of the plurality of cables to pull their corresponding foldable leg towards the ceiling thus causing each leg to be folded inside.

12. The foldable table of claim 1, wherein when each of the gears begin rotating in a direction opposite to the one direction, the cable attached to the rotating gear begins to be unwrapped around the rotating gear.

13. The foldable table of claim 12, wherein unwrapping the cable is configured to gradually lower the table top to a floor.

14. The foldable table of claim 1, wherein the table top is round in shape.

15. The foldable table of claim 1, wherein the table top is oval in shape.

16. The foldable table of claim 1, wherein the table top is rectangular in shape.

* * * * *